US011632609B1

(12) United States Patent
Lee et al.

(10) Patent No.: US 11,632,609 B1
(45) Date of Patent: Apr. 18, 2023

(54) THIN DOUBLE-SIDED VIBRATING SPEAKER

(71) Applicant: FORTUNE GRAND TECHNOLOGY INC., Taoyuan (TW)

(72) Inventors: Ping-Yu Lee, Taoyuan (TW); Jian Lv, Taoyuan (TW); Yi-Yong Li, Taoyuan (TW); Zan-Hua Liu, Taoyuan (TW); Chun-Yan Zhang, Taoyuan (TW)

(73) Assignee: FORTUNE GRAND TECHNOLOGY INC., Taoyuan (TW)

( * ) Notice: Subject to any disclaimer, the term of this patent is extended or adjusted under 35 U.S.C. 154(b) by 0 days.

(21) Appl. No.: 17/669,380

(22) Filed: Feb. 11, 2022

(51) Int. Cl.
*H04R 1/02* (2006.01)
*H04R 1/28* (2006.01)

(52) U.S. Cl.
CPC ..... *H04R 1/021* (2013.01); *H04R 1/2819* (2013.01)

(58) Field of Classification Search
CPC ..... H04R 2209/026
See application file for complete search history.

(56) References Cited

U.S. PATENT DOCUMENTS

2016/0021441 A1* 1/2016 Shao ..... H04R 1/24 381/412
2022/0312124 A1* 9/2022 Ko ..... H04R 9/045

* cited by examiner

*Primary Examiner* — Mark Fischer

(57) ABSTRACT

A thin double-sided vibrating speaker includes a magnet member, a first vibration assembly and a second vibration assembly; the magnet member includes a main magnetic plate, a first magnetic path unit, a second magnetic path unit and side magnetic path units, the first magnetic path unit is disposed on one surface of the main magnetic plate, the second magnetic path unit is disposed on another surface of the main magnetic plate, the side magnetic path units are disposed on the main magnetic plate and correspond to two sides of the first magnetic path unit, the first vibration assembly is disposed on one surface of the magnet member, and the second vibration assembly is disposed on another surface of the magnet member. Accordingly, in addition to achieving the requirement of thinning, the thin double-sided vibrating speaker of the present disclosure also has the effect of vibration reduction and two-way sounding.

18 Claims, 12 Drawing Sheets

A-A

B-B

THIN DOUBLE-SIDED VIBRATING SPEAKER

BACKGROUND OF THE INVENTION

1. Field of the Invention

The present disclosure relates to a thin double-sided vibrating speaker, and in particular to a thin double-sided vibrating speaker, which can achieve the requirement of thinning and the effect of vibration reduction and two-way sounding.

2. Description of the Related Art

In general, in order to achieve the purpose of two-way sounding of a speaker, the two vibration components and the two magnet members are usually combined in a symmetrical design, resulting in the problem that it is not easy to achieve the thinning of the speaker.

Thus, it is desirable to develop a thin double-sided vibrating speaker, which is expected to achieve the requirement of thinning, and also have the purpose of vibration reduction and two-way sounding that are to be actively disclosed by the disclosure.

BRIEF SUMMARY OF THE INVENTION

In view of the shortcomings of the above-mentioned prior art, the inventor felt that it was not perfect, and exhausted his mind to research carefully into a way for overcoming the problems, and then developed a thin double-sided vibrating speaker, with a view to achieving the requirement of thinning, and also having the purpose of vibration reduction and two-way sounding.

To achieve the above objective and other objectives, the present disclosure provides a thin double-sided vibrating speaker, comprising: a magnet member, a first vibration assembly and a second vibration assembly. The magnet member includes a main magnetic plate, a first magnetic path unit, a second magnetic path unit and two side magnetic path units, the main magnetic plate has a central plate body and two side plate bodies, one surface of the central plate body has a first assembly part, another surface of the central plate body has a second assembly part, and the central plate body has a communication part, the communication part is communicated to the first assembly part and the second assembly part, and the central plate body is provided with at least one ventilation part that communicates the surface and another surface thereof, each the side plate body is disposed on two sides of the central plate body, a surface of each the side plate body has a third assembly part, the first magnetic path unit is disposed on the first assembly part, the second magnetic path unit is disposed on the second assembly part, each the side magnetic path unit is disposed on each the third assembly part, the first magnetic path unit and the second magnetic path unit are laminated with each other through the communication part, the side magnetic path units respectively correspond to two sides of the first magnetic path unit; the first vibration assembly includes a first speaker frame, a first voice coil and a first diaphragm, the first speaker frame is configured with a surface of the magnet member, the first voice coil is movably configured between the first magnetic path unit and each the side magnetic path unit, the first diaphragm is configured with the first speaker frame; the second vibration assembly includes a second speaker frame, a second voice coil and a second diaphragm, the second speaker frame is configured with another surface of the magnet member, the second voice coil is movably configured around the outer periphery of the second magnetic path unit, the second diaphragm is configured with the second speaker frame, the second speaker frame and the first speaker frame are combined with each other.

To achieve the above objective and other objectives, the present disclosure further provides a thin double-sided vibrating speaker, comprising: a magnet member, a first vibration assembly and a second vibration assembly. The magnet member includes a main magnetic plate, a first magnetic path unit, a second magnetic path unit and two side magnetic path units, the main magnetic plate has a central plate body and two side plate bodies, one surface of the central plate body has a first assembly part, another surface of the central plate body has a second assembly part, the central plate body is provided with at least one ventilation part that communicates the surface and another surface thereof, each the side plate body is disposed on two sides of the central plate body, a surface of each the side plate body has a third assembly part, the first magnetic path unit is disposed on the first assembly part, the second magnetic path unit is disposed on the second assembly part, each the side magnetic path unit is disposed on each the third assembly part, the side magnetic path units respectively correspond to two sides of the first magnetic path unit; the first vibration assembly includes a first speaker frame, a first voice coil and a first diaphragm, the first speaker frame is configured with a surface of the magnet member, the first voice coil is movably configured between the first magnetic path unit and each the side magnetic path unit, the first diaphragm is configured with the first speaker frame; the second vibration assembly includes a second speaker frame, a second voice coil and a second diaphragm, the second speaker frame is configured with another surface of the magnet member, the second voice coil is movably configured around the outer periphery of the second magnetic path unit, the second diaphragm is configured with the second speaker frame, the second speaker frame and the first speaker frame are combined with each other.

In the above-mentioned thin double-sided vibrating speaker, the first voice coil is movably configured outside the central plate body, the central plate body has four chamfers.

In the above-mentioned thin double-sided vibrating speaker, two sides of the central plate body are respectively connected to each the side plate body by a bending segment, another surface of the central plate body forms a recess of the second assembly part by the bending segments, and each the third assembly part is lower than the first assembly part, and thus the side magnetic path units respectively correspond to two sides of the first magnetic path unit.

In the above-mentioned thin double-sided vibrating speaker, two ends of each the side plate body respectively have a limiting part, an inside edge of the second speaker frame has a fixing part correspondingly connecting each the limiting part.

In the above-mentioned thin double-sided vibrating speaker, the first magnetic path unit has at least a first magnet and a first magnetic plate, the first magnet is disposed on the first assembly part, the first magnetic plate is disposed on the first magnet, the second magnetic path unit has at least a second magnet and a second magnetic plate, the second magnet is disposed on the second assembly part, the second magnetic plate is disposed on the second magnet, and the first magnet and the second magnet are laminated with each other through the communication part.

In the above-mentioned thin double-sided vibrating speaker, each the side magnetic path unit has at least one side magnet and at least one side magnetic plate, the side magnet is disposed on the third assembly part, the side magnetic plate is provided on the side magnet.

In the above-mentioned thin double-sided vibrating speaker, each the side magnetic path unit has multiple side magnets, there is an air vent formed between the adjacent side magnets, the air vent is communicated to the at least one ventilation part, and the first speaker frame and the second speaker frame are respectively provided with a corresponding breathable notch, the breathable notches communicate the at least one ventilation part.

In the above-mentioned thin double-sided vibrating speaker, a width and a length of the first voice coil are respectively greater than a width and a length of the second voice coil, a magnetic force of the first magnetic path unit is less than a magnetic force of the second magnetic path unit.

In the above-mentioned thin double-sided vibrating speaker, two ends of one side the first speaker frame are provided with a first conductive part and a first lead groove, two leads of the first voice coil are respectively electrically connected to each the first conductive part via each the first lead groove; two ends of one side the second speaker frame are provided with a second conductive part and a second lead groove, two leads of the second voice coil are respectively electrically connected to each the second conductive part via each the second lead groove, each the first conductive part is electrically connected to each the second conductive part.

Accordingly, in addition to achieving the requirement of thinning, the thin double-sided vibrating speaker of the present disclosure also has the effect of vibration reduction and two-way sounding.

DETAILED DESCRIPTION OF THE INVENTION

Figure 1:
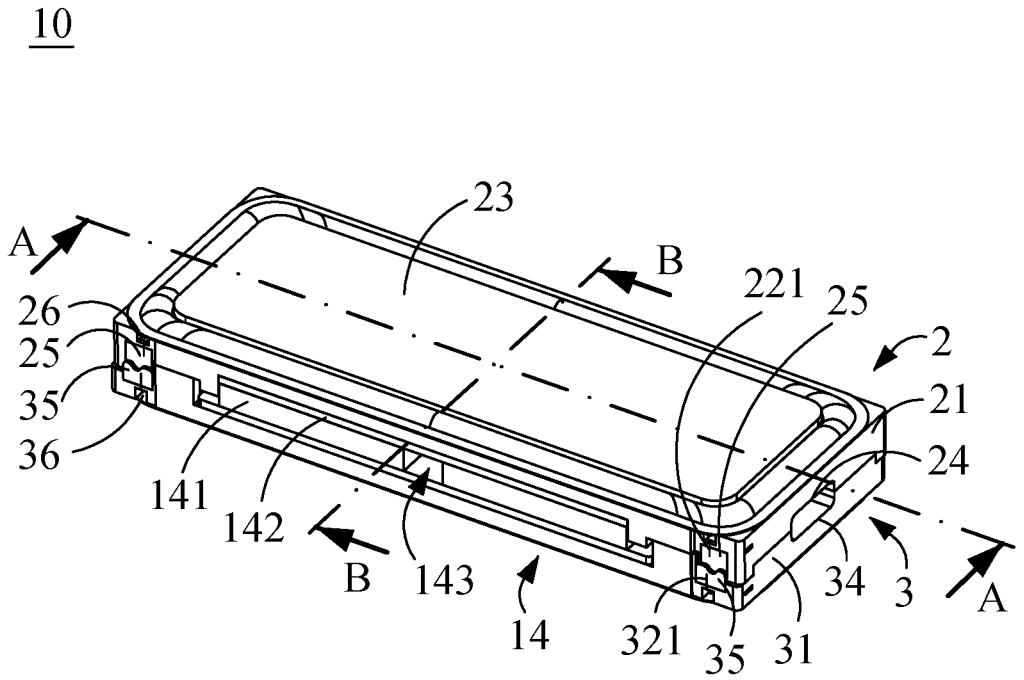
FIG. 1 is a schematic perspective view of a thin double-sided vibrating speaker of the present disclosure.

To facilitate understanding of the object, characteristics and effects of this present disclosure, embodiments together with the attached drawings for the detailed description of the present disclosure are provided.

Referring to FIGS. 1 to 9, as shown in the drawings, the present disclosure provides a thin double-sided vibrating speaker 10 comprising: a magnet member 1, a first vibration assembly 2 and a second vibration assembly 3.

The magnet member 1 includes a main magnetic plate 11, a first magnetic path unit 12, a second magnetic path unit 13 and two side magnetic path units 14, the main magnetic plate 11 has a central plate body 111 and two side plate bodies 112, one surface of the central plate body 111 has a first assembly part 1111, another surface of the central plate body 111 has a second assembly part 1112, and the central plate body 111 has a communication part 1113 (e.g., a communication hole), the communication part 1113 is communicated to the first assembly part 1111 and the second assembly part 1112, and the central plate body 111 is provided with at least one ventilation part 1114 (e.g., air vent) that communicates the surface and another surface thereof, each the side plate body 112 is disposed on two sides of the central plate body 111, a surface of each the side plate body 112 has a third assembly part 1121, the first magnetic path unit 12 is disposed on the first assembly part 1111, the second magnetic path unit 13 is disposed on the second assembly part 1112, each the side magnetic path unit 14 is disposed on each the third assembly part 1121, the first magnetic path unit 12 and the second magnetic path unit 13 are laminated with each other through the communication part 1113, each the side magnetic path unit 14 corresponds to two sides of the first magnetic path unit 12.

The first vibration assembly 2 includes a first speaker frame 21, a first voice coil 22 and a first diaphragm 23, the first speaker frame 21 is configured with a surface of the magnet member 1, the first voice coil 22 is movably configured in a magnetic gap between the first magnetic path unit 12 and each the side magnetic path unit 14, the first diaphragm 23 is configured with the first speaker frame 21.

The second vibration assembly 3 includes a second speaker frame 31, a second voice coil 32 and a second diaphragm 33, the second speaker frame 31 is configured with another surface of the magnet member 1, the second voice coil 32 is movably configured in a magnetic gap around the outer periphery of the second magnetic path unit 13, the second diaphragm 33 is configured with the second speaker frame 31, the second speaker frame 31 and the first speaker frame 21 are combined with each other.

Figure 4:
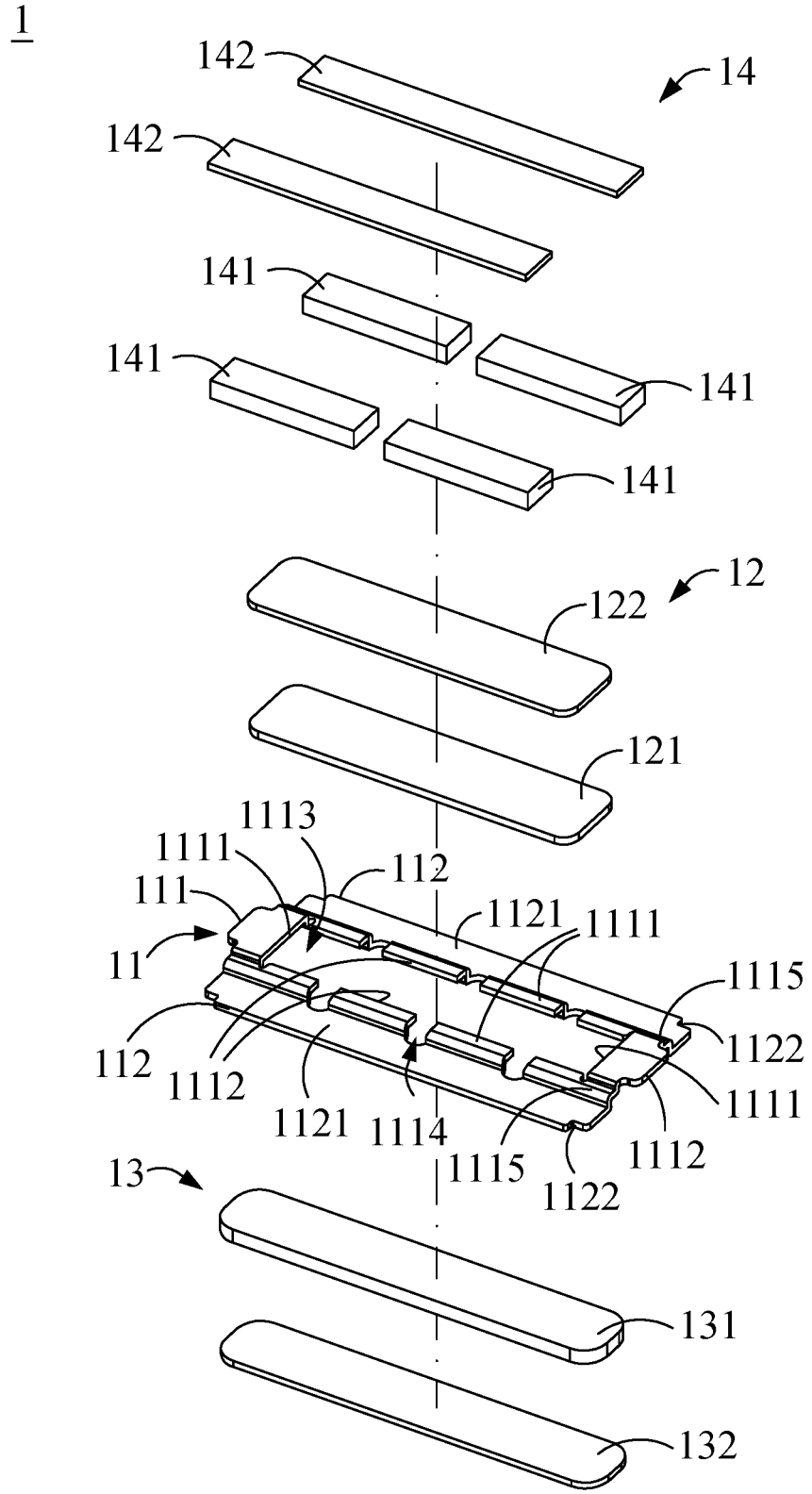
FIG. 4 is a schematic exploded view of a magnet member of the present disclosure.
Figure 5:
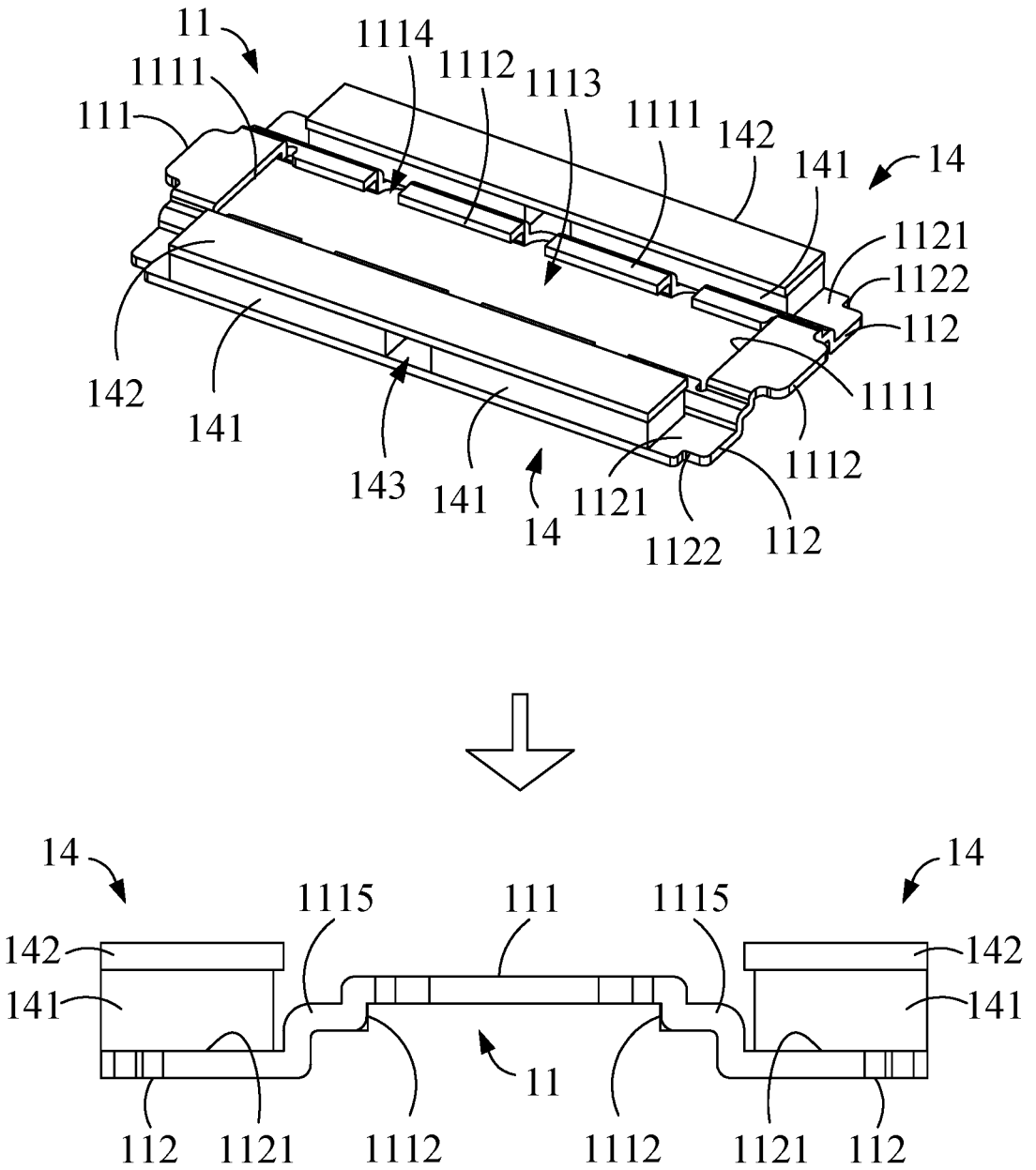
FIG. 5 is a schematic view 1 of an assembly state of the magnet member of the present disclosure.
Figure 6A:
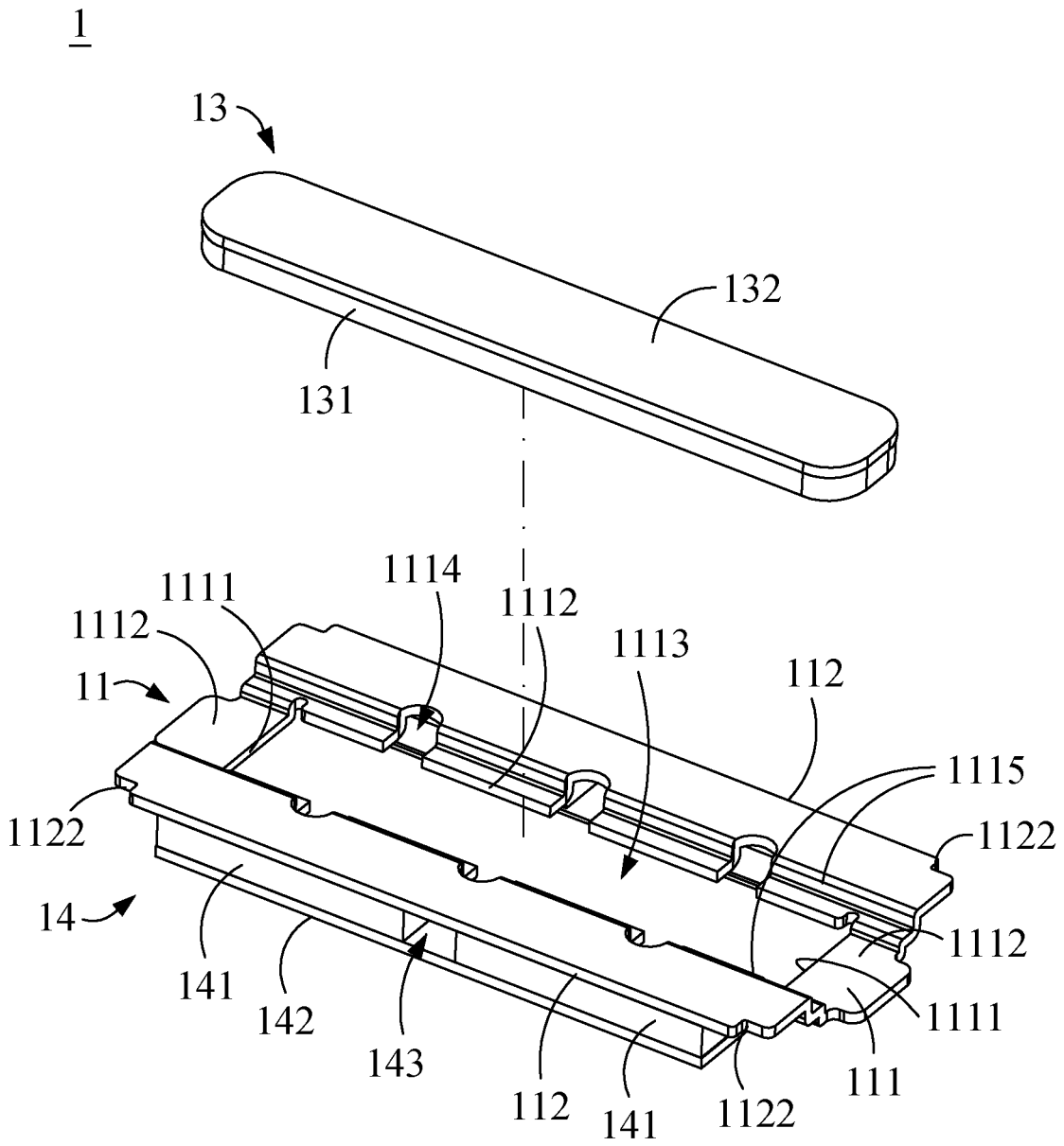
FIG. 6A is a schematic view 2 of an assembly state of the magnet member of the present disclosure.
Figure 6B:
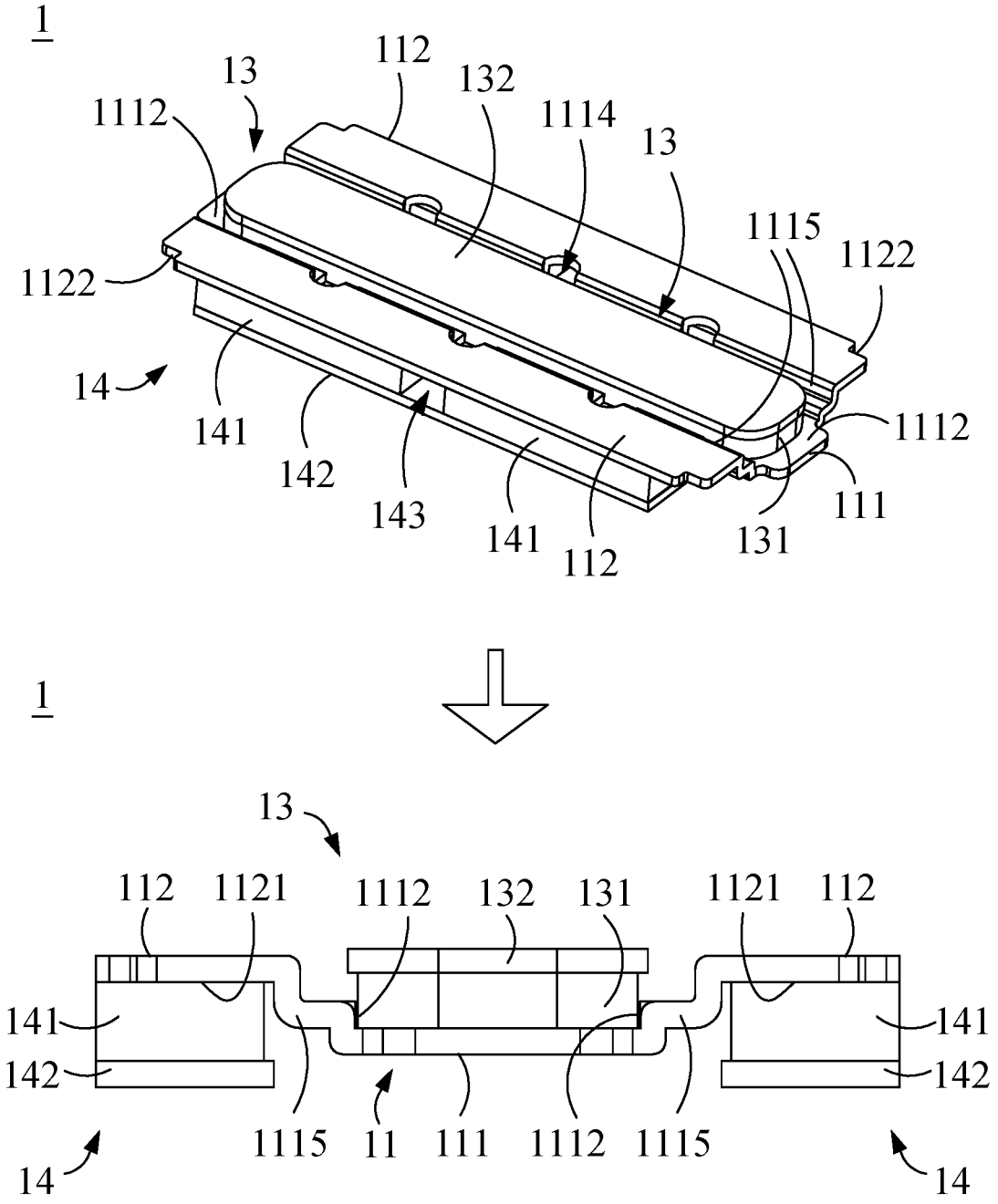
FIG. 6B is a schematic view 3 of an assembly state of the magnet member of the present disclosure.
Figure 7A:
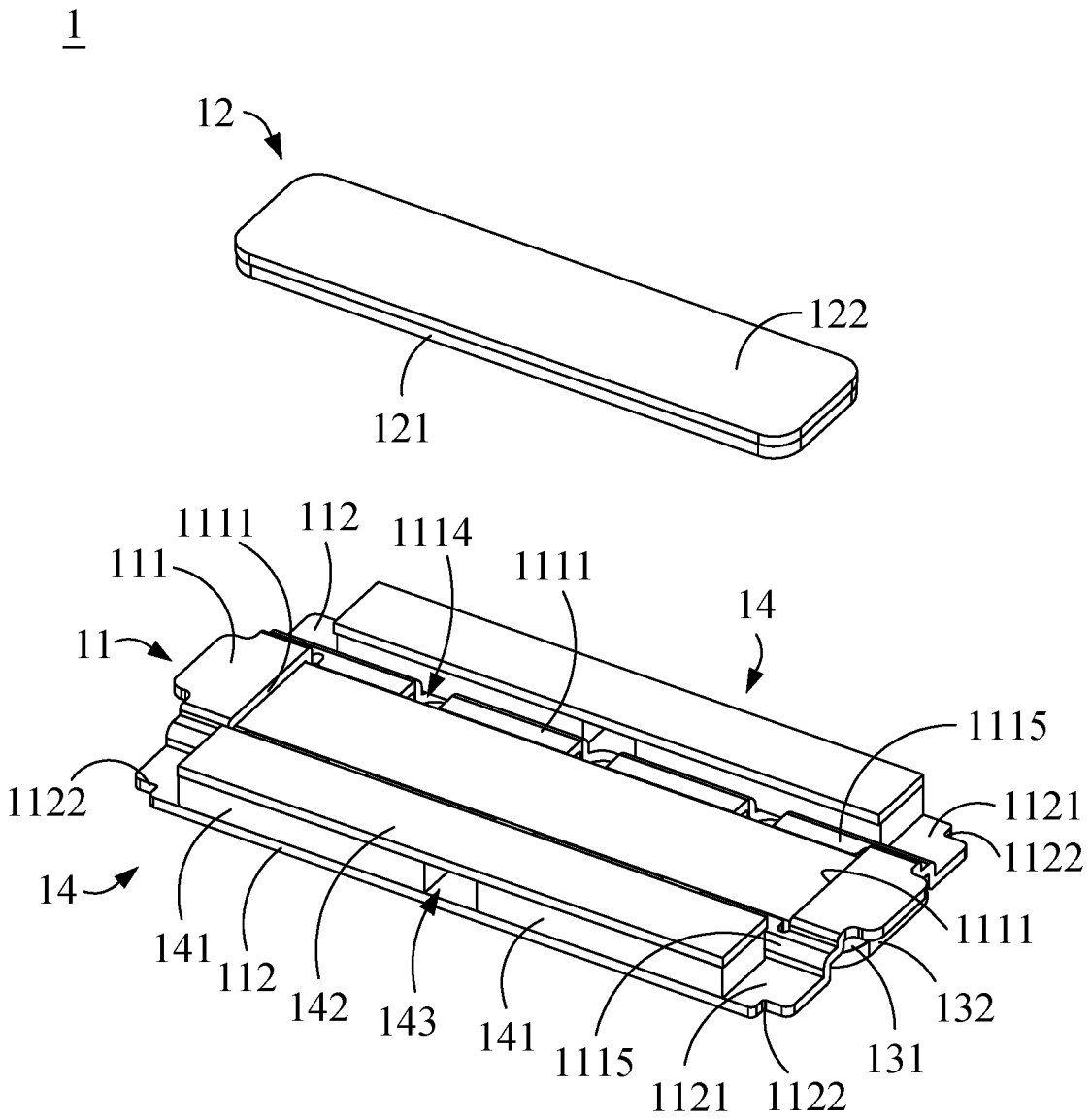
FIG. 7A is a schematic view 4 of an assembly state of the magnet member of the present disclosure.
Figure 7B:
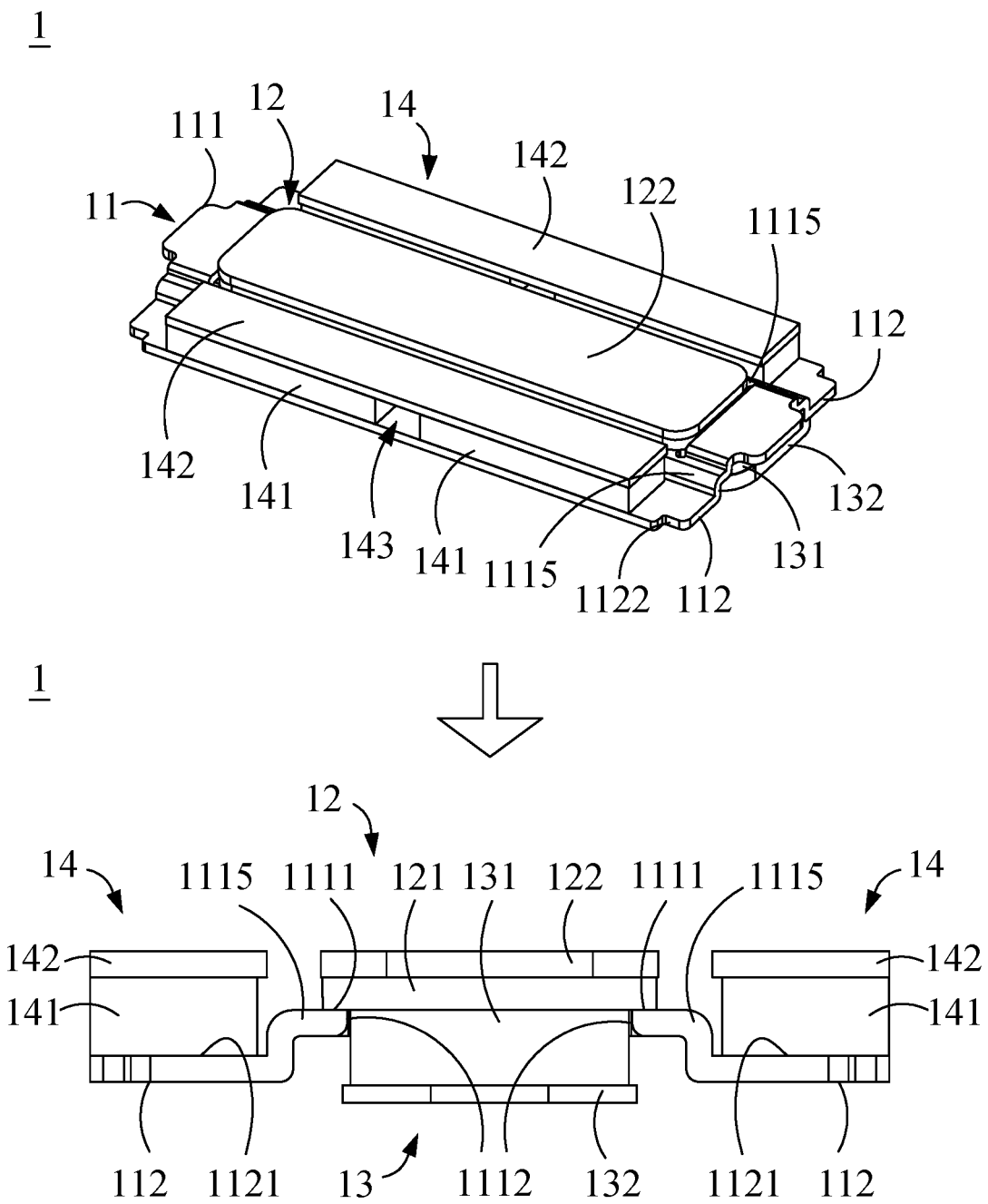
FIG. 7B is a schematic view 5 of an assembly state of the magnet member of the present disclosure.

As shown in FIGS. 4 to 7B, the lower figure of FIG. 5 is a side view of the upper figure, the lower figure of FIG. 6B is a side view of the upper figure, the lower figure of FIG. 7B is a cross-sectional view of the upper figure, when the magnet member 1 is assembled, each the side magnetic path unit 14 may be fixed to each the side plate body 112 of the main magnetic plate 11, and then magnetized, after that, the second magnetic path unit 13 is first magnetized, and then fixed on the second assembly part 1112 of the central plate body 111, finally, the first magnetic path unit 12 is first magnetized, and then fixed to the first assembly part 1111 of the central plate body 111 with a related jig (not shown in figures), and the first magnetic path unit 12 and the second magnetic path unit 13 are bonded to each other, and the polarity of a lamination surface of the first magnetic path unit 12 and the second magnetic path unit 13 is the same (i.e., the polarity of the lamination surface of the first magnetic path unit 12 and the second magnetic path unit 13 is repulsive), the first magnetic path unit 12 and the second magnetic path unit 13 are laminated with each other through the communication part 1113, the side magnetic path units 14 respectively correspond to two sides of the first magnetic path unit 12. After the above assembly is completed, the first voice coil 22 of the first vibration assembly 2 is movably configured in a magnetic gap between the first magnetic path unit 12 and each the side the magnetic path unit 14, and the second voice coil 32 of the second vibration assembly 3 is movably configured in a magnetic gap around the outer periphery of the second magnetic path unit 13, and the second speaker frame 31 and the first speaker frame 21 are combined with each other. After the foregoing combination, the first magnetic path unit 12 and the second magnetic path unit 13 are directly laminated to reduce the overall height of the magnet member 1, and the magnet member 1, the first vibration assembly 2 and the second vibration assembly 3 are combined with each other to form a thin double-sided vibrating speaker 10.

As shown in FIGS. 1 to 4 and FIGS. 8 to 10, when the thin double-sided vibrating speaker 10 of the present disclosure is used, it may be combined with a cabinet (not shown in figures), so that the first voice coil 22 forms an upper independent magnetic field by the first magnetic path unit 12 and each the side magnetic path unit 14, and the second voice coil 32 forms a lower independent magnetic field by the second magnetic path unit 13, so that the thin double-sided vibrating speaker 10 forms two completely independent magnetic fields located in the upper and lower positions, and thus the first voice coil 22 and the second voice coil 32 bring the vibration of the first diaphragm 23 and the second diaphragm 33 through the electromagnetic action.

When the first vibration assembly 2 and the second vibration assembly 3 actuate, the first voice coil 22 and the second voice coil 32 receive an electronic signal inputted from outside, so that the first diaphragm 23 and the second diaphragm 33 simultaneously actuate outward and simultaneously actuate inward, when the first diaphragm 23 and the second diaphragm 33 simultaneously actuate outward, the air is pushed to vibrate and sound, and when the first diaphragm 23 and the second diaphragm 33 simultaneously actuate inward, the two forces will offset each other, so that the first vibration assembly 2 and the second vibration assembly 3 implement the function of vibration reduction, in order to avoid the force generated by the first diaphragm 23 and the second diaphragm 33 actuating to drive the entire thin double-sided vibrating speaker 10 followed by vibration.

Figure 8:
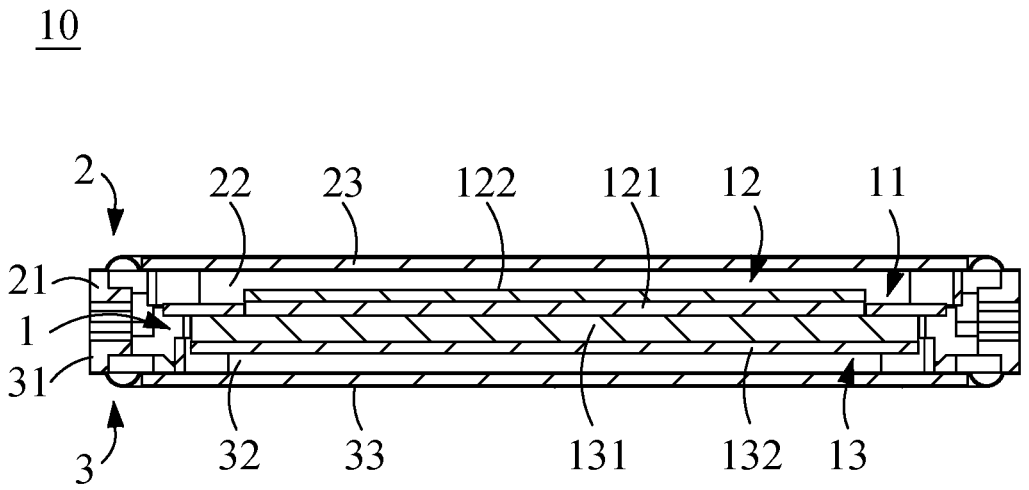
FIG. 8 is a schematic sectional state view along A-A of FIG. 1 of the present disclosure.
Figure 10:
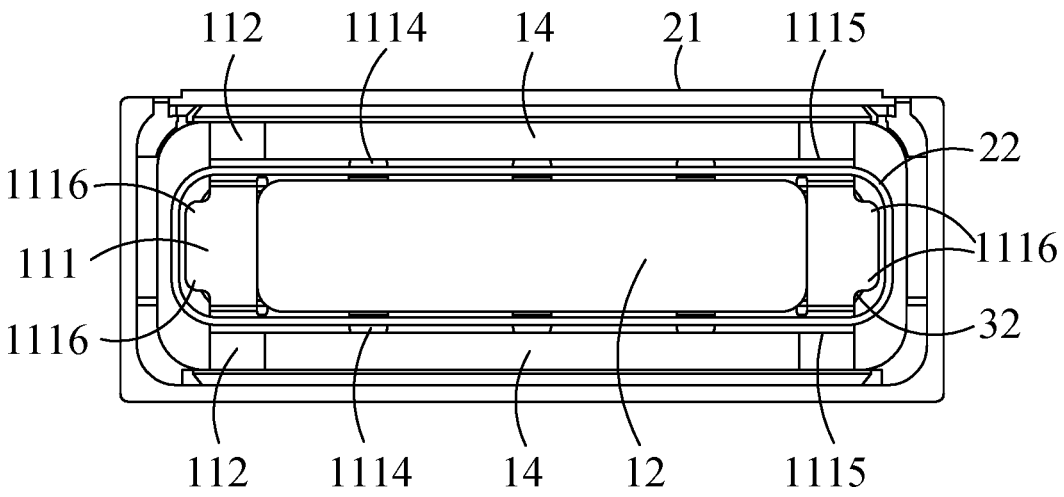
FIG. 10 is a schematic view of a first voice coil movably configured outside a central plate body of the present disclosure.

Further, in addition to positioning the first magnetic path unit 12 with the first assembly part 1111, the central plate body 111 accommodates the second magnetic path unit 13 with the second assembly part 1112, because the central plate body 111 itself is also part of the magnetic plate, the central plate body 111 can also extend to the two side plate bodies 112 from two ends thereof to play a magnetic conductive function, so that the magnetic force of the first magnetic path unit 12 can be extended to two ends of a long axis of the first voice coil 22 (as shown in FIG. 8 and FIG. 10). Further, as shown in FIG. 10, since the first voice coil 22 may be movably configured outside the central plate body 111, the central plate body 111 may have four chamfers 1116 to make way for the first voice coil 22, thereby avoiding the first voice coil 22 to collide with the central plate body 111 causing interference when vibrating.

Further, since the central plate body 111 of the main magnetic plate 11 has multiple ventilation parts 1114 communicating one surface and another surface of the central plate body 111, when the first vibration assembly 2 and the second vibration assembly 3 actuate to generate air flow, it may be fully offset by the ventilation parts 1114, in order to achieve the purpose of vibration control of the thin double-sided vibrating speaker 10, so as to avoid resonance to produce noise and distortion.

Accordingly, the thin double-sided vibrating speaker 10 of the present disclosure may achieve the requirement of thinning and the effect of vibration reduction and two-way sounding, by the design of double-sided diaphragms including the first diaphragm 23 and the second diaphragm 33, a two-way sounding effect is implemented, thereby enhancing the output volume and bass effect of the thin double-sided vibrating speaker 10. More importantly, the first vibration assembly 2 and the second vibration assembly 3 may be actuated at the same time, and the force between each other is offset, and the vibration control of the thin double-sided vibrating speaker 10 is further increased, in order to prevent the first diaphragm 23 and the second diaphragm 33 at vibrating from driving the entire thin double-sided vibrating speaker 10 to produce unnecessary vibration, so as to avoid resonance to produce noise and distortion. In addition, the thin double-sided vibrating speaker 10 of the present disclosure may form an upper independent magnetic field by the first magnetic path unit 12 and each the side magnetic path unit 14, and form a lower independent magnetic field by the second magnetic path unit 13, and two independent magnetic fields located in the upper and lower positions share a main magnetic plate 11, so it will not increase the overall height of the thin double-sided vibrating speaker 10. Further, the thin double-sided vibrating speaker 10 of the present disclosure may make the air flow and force generated by the first diaphragm 23 and the second diaphragm 33 actuating offset sufficiently by the cooperation of each the ventilation part 1114, part of the gas is discharged to the outside from the thin double-sided vibrating speaker 10, in order to adjust the excessive air flow inside the thin double-sided vibrating speaker 10, and the vibration control of the thin double-sided vibrating speaker 10 is further increased, in order to prevent the first diaphragm 23 and the second diaphragm 33 at vibrating from driving the entire thin double-sided vibrating speaker 10 to produce unnecessary vibration, thereby achieving the vibration control of the thin double-sided vibrating speaker 10 to avoid resonance to produce noise and distortion.

Figure 9:
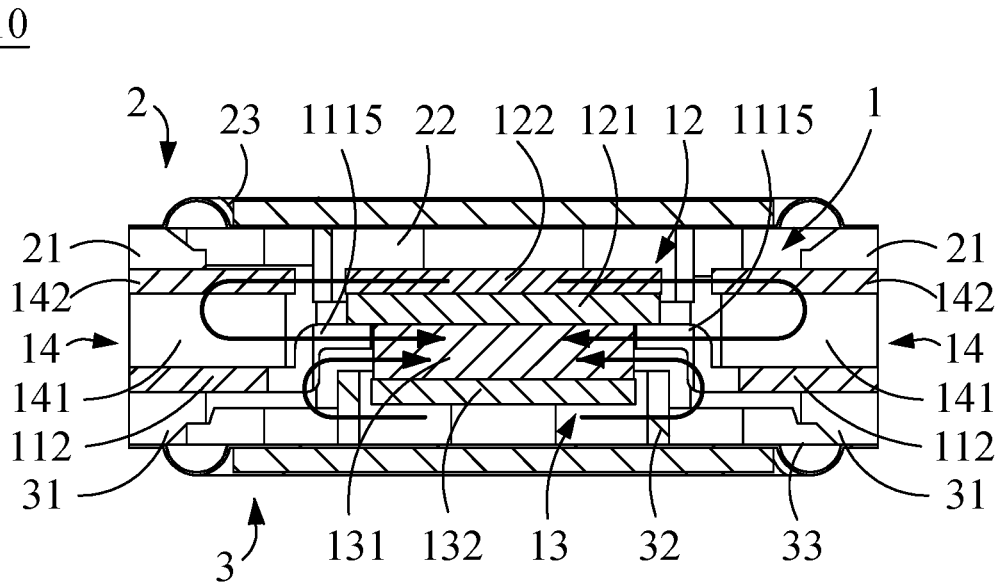
FIG. 9 is a schematic sectional state view along B-B of FIG. 1 of the present disclosure.

As shown in FIGS. 4 to 7B, in an embodiment of the present disclosure, two sides of the central plate body 111 are respectively connected to each the side plate body 112 by a bending segment 1115, another surface of the central plate body 111 forms a recess of the second assembly part 1112 by the bending segments 1115, and each the third assembly part 1121 is lower than the first assembly part 1111, and thus the side magnetic path units 14 respectively correspond to two sides of the first magnetic path unit 12. As shown in FIGS. 4 and 7B, top surfaces of the side plate bodies 112 may respectively be a first step platform (third assembly part 1121) for setting the side magnetic path unit 14, top surfaces of the bending segments 1115 may respectively be a second step platform, a top surface of the central plate body 111 may be a third step platform. Further, as shown in FIG. 4, FIG. 7A and FIG. 7B, the communication part 1113 may be a rectangular hole through the third step platform, the first assembly part 1111 may be top surfaces of the two long sides of the communication part 1113 and end surfaces of the two short sides of the communication part 1113 for connecting the first magnetic path unit 12, thereby limiting the first magnetic path unit 12 between the end surfaces of the two short sides of the communication part 1113. As shown in FIGS. 6A and 6B, the second assembly part 1112 may be located between the second step platforms, the second assembly part 1112 may be the side surfaces of the two long sides of the communication part 1113 and the top surfaces of the two short sides of the communication part 1113 for connecting the second magnetic path unit 13, thereby limiting the second magnetic path unit 13 between the side surfaces of the two long sides of the communication part 1113. Accordingly, by the design of the main magnetic plate 11, the first magnetic path unit 12 and the second magnetic path unit 13 are laminated with each other through the communication part 1113, and the side magnetic path units 14 respectively correspond to two sides of the first magnetic path unit 12, in order to reduce the overall height of the magnet member 1, thereby achieving the requirement of thinning. In addition, when the thickness of the main magnetic plate 11 is only 0.5 mm that is very thin, the communication part 1113 will reduce the strength of the main magnetic plate 11. Thus, by the first assembly part 1111, the second assembly part 1112 and the communication part 1113 assembling with the first magnetic path unit 12 and the second magnetic path unit 13, the strength of the main magnetic plate 11 may be increased. Further, as shown in FIG. 9, the first voice coil 22 and the second voice coil 32 may respectively be accommodated above and below the second step platform, a depth of the recess formed between the inside of the bending segments 1115 may be adjusted to match the desired vibration amplitude of the first voice coil 22 and the second voice coil 32.

Figure 2:
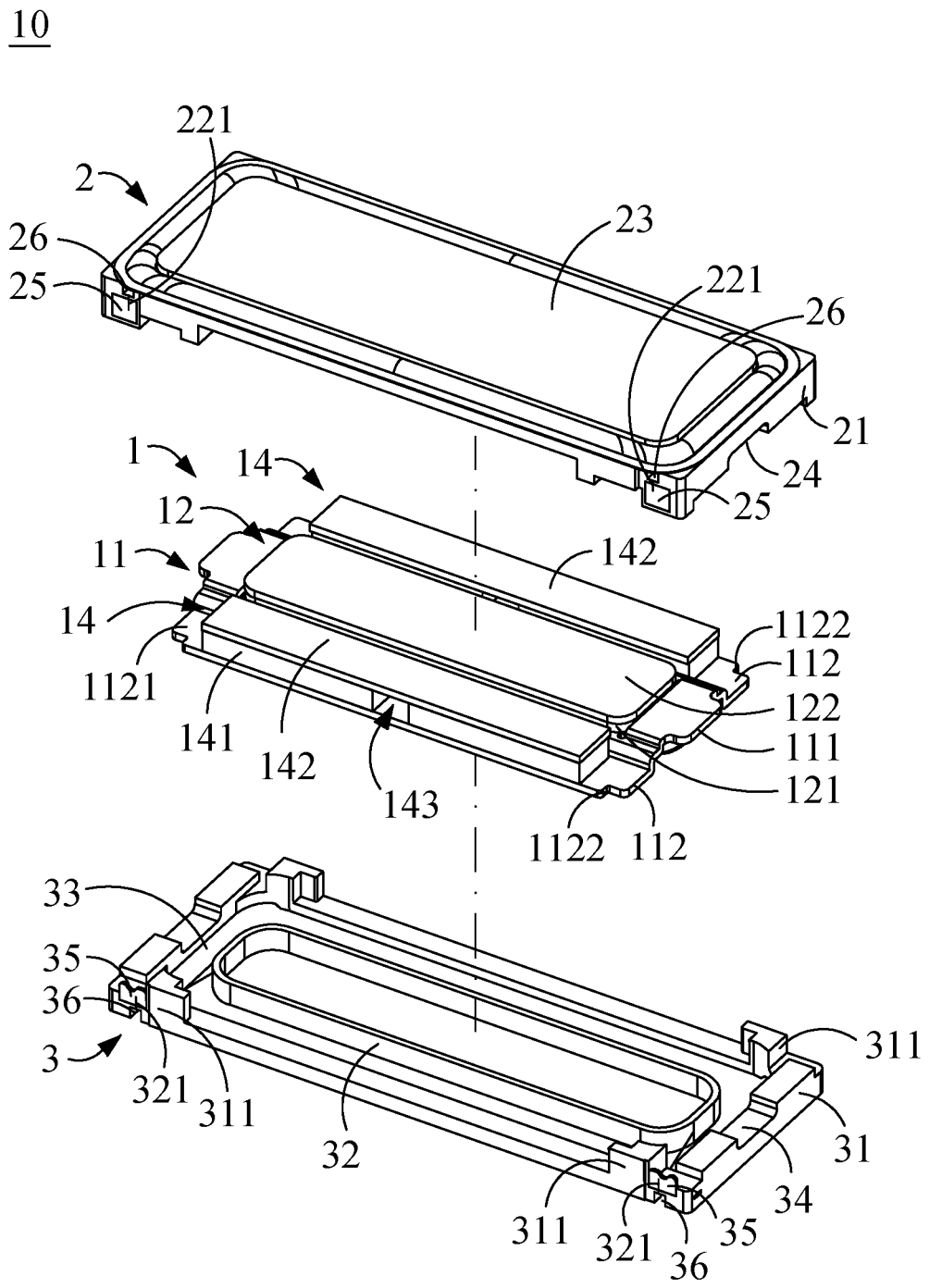
FIG. 2 is a schematic exploded view of the thin double-sided vibrating speaker of the present disclosure.
Figure 3:
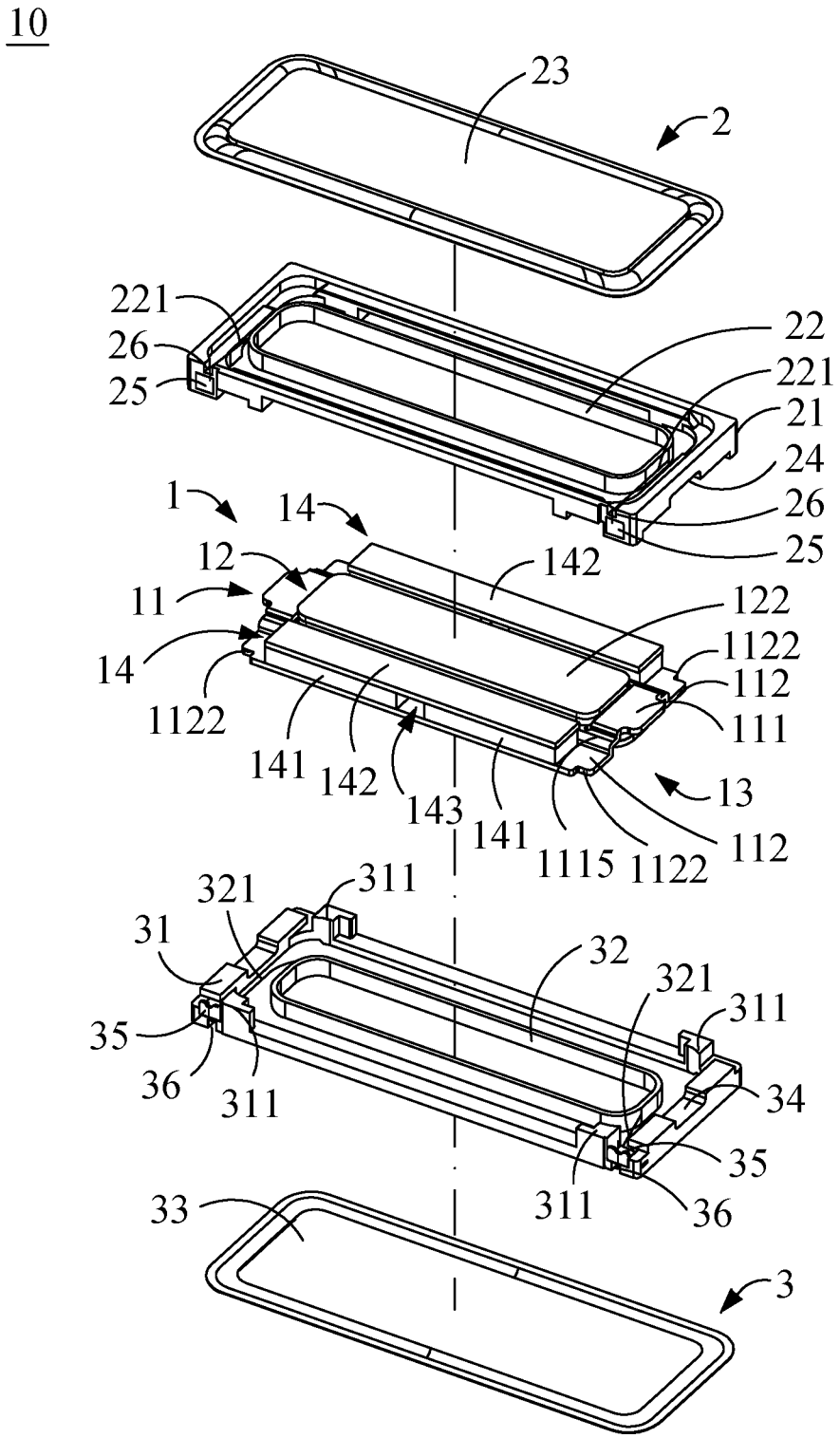
FIG. 3 is another schematic exploded view of the thin double-sided vibrating speaker of the present disclosure.

As shown in FIGS. 2 and 3, in an embodiment of the present disclosure, two ends of each the side plate body 112 respectively have a limiting part 1122 (e.g., notch), an inside edge of the second speaker frame 31 has a fixing part 311 (e.g., convex body) correspondingly connecting each the limiting part 1122. Accordingly, the main magnetic plate 11 may use each the limiting part 1122 of each the side plate body 112 to combine with the fixing part 311 of the second speaker frame 31, so that the magnet member 1 is firmly assembled.

As shown in FIGS. 4 to 9, in an embodiment of the present disclosure, the first magnetic path unit 12 has at least a first magnet 121 and a first magnetic plate 122, the first magnet 121 is disposed on the first assembly part 1111, the first magnetic plate 122 is disposed on the first magnet 121; the second magnetic path unit 13 has at least a second magnet 131 and a second magnetic plate 132, the second magnet 131 is disposed on the second assembly part 1112, the second magnetic plate 132 is disposed on the second magnet 131, and the second magnet 131 of the second magnetic path unit 13 and the first magnet 121 of the first magnetic path unit 12 are laminated with each other through the communication part 1113, and the polarity of a lamination surface of the first magnet 121 and the second magnet 131 is the same (i.e., the polarity of the lamination surface is repulsive); each the side magnetic path unit 14 has at least one side magnet 141 and at least one side magnetic plate 142, the side magnet 141 is disposed on the third assembly part 1121, the side magnetic plate 142 is provided on the side magnet 141. Accordingly, an upper independent magnetic field is formed by the first magnetic path unit 12 and each the side magnetic path unit 14, and a lower independent magnetic field is formed by the second magnetic path unit 13, so that the thin double-sided vibrating speaker 10 forms two completely independent magnetic fields located in the upper and lower positions, and thus the first voice coil 22 and the second voice coil 32 bring the vibration of the first diaphragm 23 and the second diaphragm 33 through the electromagnetic action.

In addition, as shown in FIGS. 2 to 7B, the first magnetic path unit 12 and each the side magnetic path unit 14 adopts a multi-magnetic design, for example: consisting of a first magnet 121 and four side magnets 141, wherein the side magnets 141 located at the same side shares a side magnetic plate 142; in addition, each side magnet 141 may also be configured with a side magnetic plate 142, that is, the design of four side magnetic plates 142, and when the aspect ratio the speaker is longer, it may also use a seven-magnetic design, that is, consisting of a first magnet 121 and six side magnets 141. Alternatively, according to the needs of practical application, the first magnetic path unit 12 and each the side magnetic path unit 14 adopts a three-magnetic design, for example: consisting of a first magnet 121 and two side magnets 141, and each the side magnet 141 has a side magnetic plate 142.

As shown in FIGS. 1 to 7B, in an embodiment of the present disclosure, when each the side magnetic path unit 14 has multiple side magnets 141, there is an air vent 143 formed between the adjacent side magnets 141, the air vent 143 is communicated to the ventilation parts 1114, and the first speaker frame 21 and the second speaker frame 31 are respectively provided with a corresponding breathable notch 24, 34, the breathable notches 24, 34 communicate the ventilation parts 1114. Accordingly, the thin double-sided vibrating speaker 10 of the present disclosure may make the air flow and force generated by the first diaphragm 23 and the second diaphragm 33 actuating offset sufficiently by the cooperation of the ventilation parts 1114, the air vents 143 and the breathable notches 24, 34, part of the gas is discharged to the outside from the thin double-sided vibrating speaker 10, in order to adjust the excessive air flow inside the thin double-sided vibrating speaker 10, and the vibration control of the thin double-sided vibrating speaker 10 is further increased, in order to prevent the first diaphragm 23 and the second diaphragm 33 at vibrating from driving the entire thin double-sided vibrating speaker 10 to produce unnecessary vibration, thereby achieving the vibration control of the thin double-sided vibrating speaker 10 to avoid resonance to produce noise and distortion.

As shown in FIGS. 3, 8 and 9, in an embodiment of the present disclosure, a width and a length of the first voice coil 22 are respectively greater than a width and a length of the second voice coil 32. In the embodiment of the present disclosure, although a magnetic force of the first magnet 121 is less than a magnetic force of the second magnet 131, the first voice coil 22 of the first vibration assembly 2 is relatively large, therefore the coil winding is longer, and the first voice coil 22 with the longer coil winding going with the first magnetic path unit 12 and each the side magnetic path unit 14 will help to enhance the electromagnetic force, such that the electromagnetic force driving the first vibration assembly 2 and the electromagnetic force driving the second vibration assembly 3 are approximately the same, and thus the displacement amounts of the first diaphragm 23 and the second diaphragm 33 at actuating are similar, so that the air flow generated by the two diaphragms can be fully offset to achieve the purpose of vibration control. In addition, as shown in FIGS. 3 and 8, the first magnetic path unit 12 may extend the magnetic field of the first magnetic path unit 12 to the neighborhood of the two short sides of the inner edge of the first voice coil 22 toward the two short sides of the first magnetic path unit 12 by the two end parts of the central plate body 111, in order to enhance the electromagnetic action between the first magnetic path unit 12 and the first voice coil 22.

As shown in FIGS. 1 to 3, in an embodiment of the present disclosure, two ends of one side the first speaker frame 21 are provided with a first conductive part 25 (e.g., L-shaped conductive plate) and a first lead groove 26, two leads 221 of the first voice coil 22 are respectively electrically connected to each the first conductive part 25 via each the first lead groove 26; two ends of one side the second speaker frame 31 are provided with a second conductive part 35 (e.g., L-shaped conductive plate) and a second lead groove 36, two leads 321 of the second voice coil 32 are respectively electrically connected to each the second conductive part 35 via each the second lead groove 36. In an embodiment of the present disclosure, the first conductive parts 25 and the second conductive parts 35 are located on the same side of the thin double-sided vibrating speaker 10, when the first speaker frame 21 and the second speaker frame 31 are assembled and combined, each the first conductive part 25 and each the second conductive part 35 will be electrically connected to each other and conducted (i.e., connecting two voice coils in parallel), wherein each the second conductive part 35 may be more convex than the second speaker frame 31, so that an external audio source signal can simultaneously actuate the first voice coil 22 and the second voice coil 32 when electrically connecting to each the second conductive part 35. In addition, in the present embodiment, two leads 221 of the first voice coil 22 may first respectively contact with each the first conductive part 25 via each the first lead groove 26, two leads 321 of the second voice coil 32 may first respectively contact with each the second conductive part 35 via each the second lead groove 36, and then the leads 221, the leads 321, the first conductive parts 25 and the second conductive parts 35 that are located on the same side may be soldered together by a soldering method.

Figure 11:
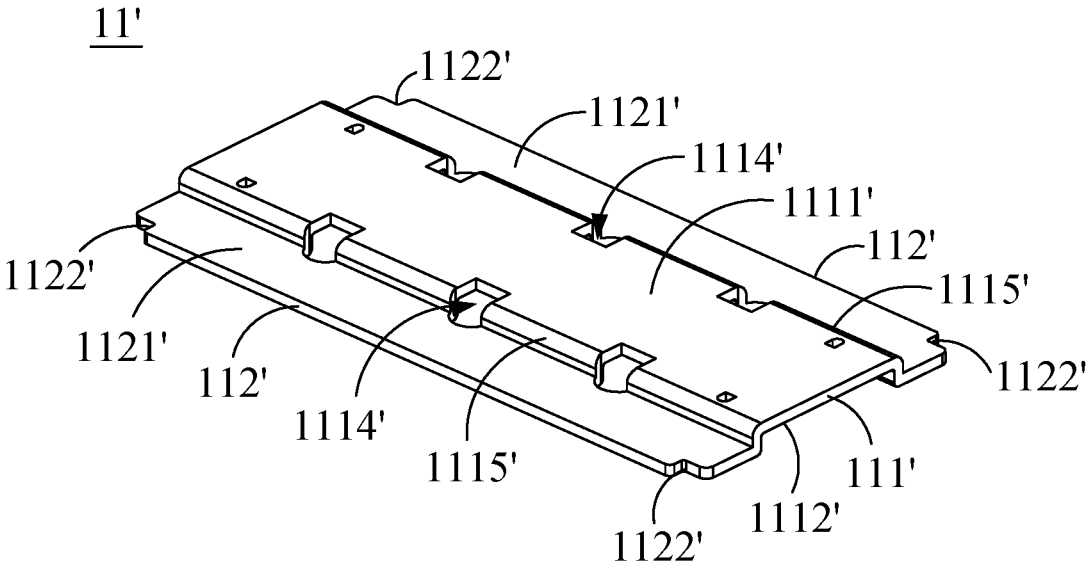
FIG. 11 is a schematic perspective view of a main magnetic plate according to another embodiment of the present disclosure.
Figure 12:
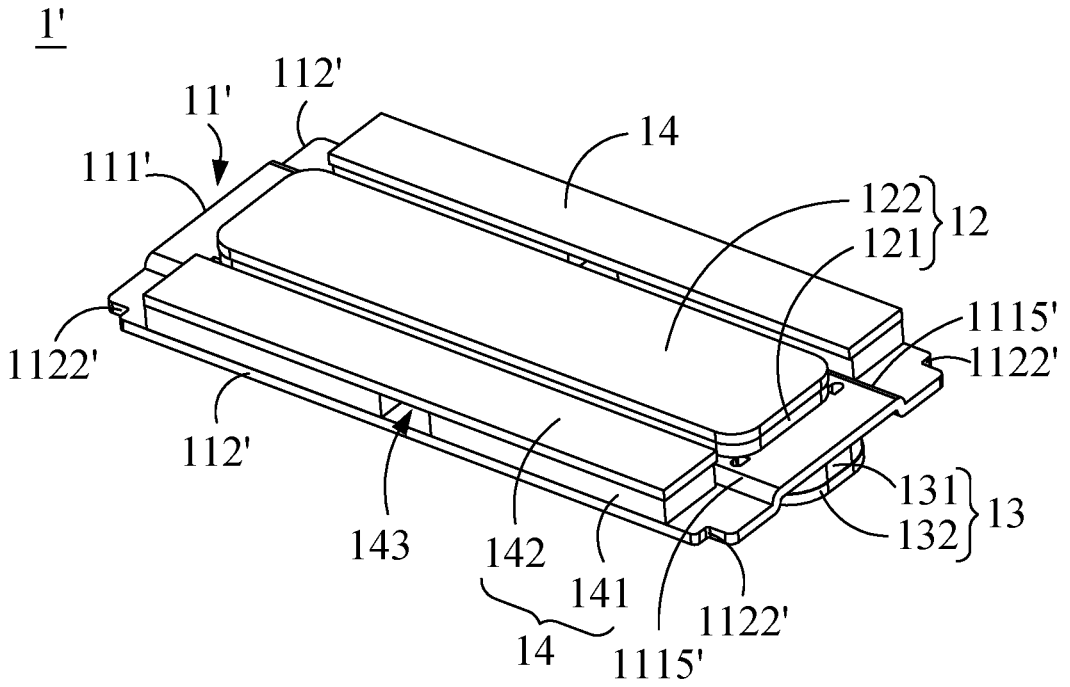
FIG. 12 is a schematic perspective view of the magnet member according to another embodiment of the present disclosure.
Figure 13:
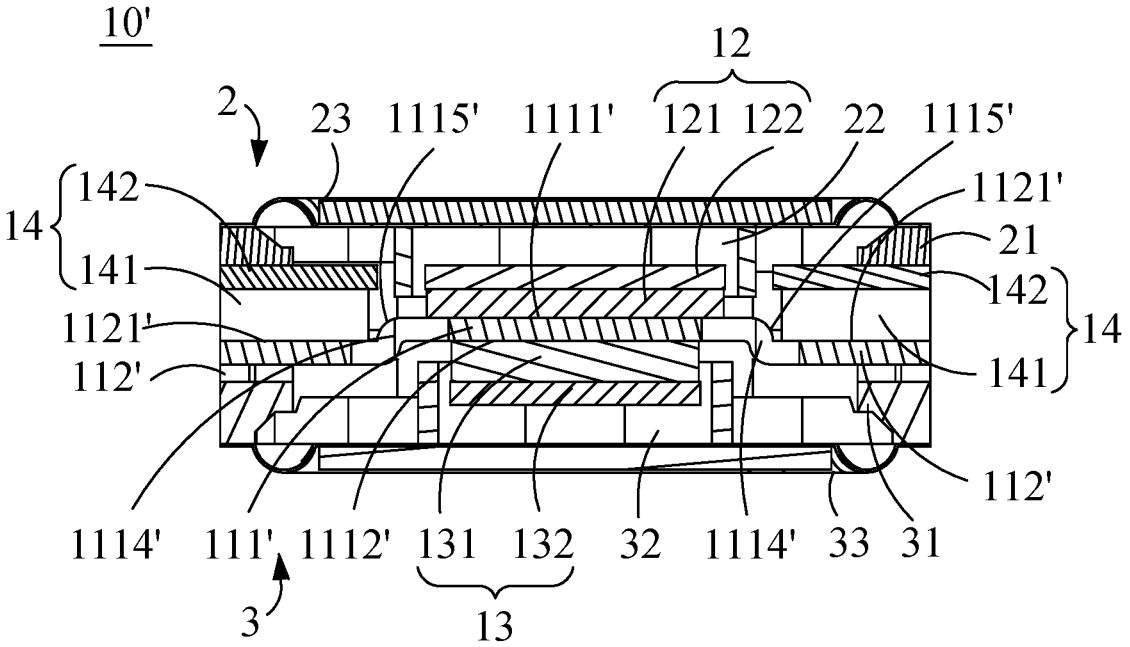
FIG. 13 is a schematic sectional state view of the thin double-sided vibrating speaker according to another embodiment of the present disclosure.

Referring to FIGS. 11 to 13, as shown in the drawings, the present disclosure provides another thin double-sided vibrating speaker 10', which differs from the above-mentioned thin double-sided vibrating speaker 10 in that the central plate body 111' of the main magnetic plate 11' of the magnet member 1' of the present embodiment fails to have a communication part, the first assembly part 1111' is located on a top surface of the central plate body 111' for setting a first magnetic path unit 12, the second assembly part 1112' is located on a bottom surface of the central plate body 111' for setting a second magnetic path unit 13. In addition, the thin double-sided vibrating speaker 10' of the present embodiment is the same as the above-mentioned thin double-sided vibrating speaker 10 in that the central plate body 111' has at least one ventilation part 1114' that communicates the top surface and the bottom surface, two side plate bodies 112' are disposed on two sides of the central plate body 111', the top surface of each the side plate body 112' has a third assembly part 1121' for setting a side magnetic path unit 14, each the side magnetic path unit 14 corresponds to two sides of the first magnetic path unit 12, two ends of each the side plate body 112' respectively have a limiting part 1122', the first vibration assembly 2 is configured on a top surface of the magnet member 1', the second vibration assembly 3 is configured on a bottom surface of the magnet member 1', two sides of the central plate body 111' are respectively connected to each the side plate body 112' by a bending segment 1115', but the difference is that the bending segment 1115' of the present embodiment is a two-fold type, the above bending segment 1115 is a four-fold type, the bottom surface of the central plate body 111' forms a recess of the second assembly part 1112' by the bending segments 1115', and each the third assembly part 1121' is lower than the first assembly part 1111', and thus the side magnetic path units 14 respectively correspond to two sides of the first magnetic path unit 12. Thus, the thin double-sided vibrating speaker 10' of the present embodiment may form an upper independent magnetic field by the first magnetic path unit 12 and each the side magnetic path unit 14, and form a lower independent magnetic field by the second magnetic path unit 13, and two independent magnetic fields located in the upper and lower positions share a main magnetic plate 11', so it will not increase the overall height of the thin double-sided vibrating speaker 10'. In addition, the remaining structure and effect that are not described in the present embodiment may refer to the above-mentioned thin double-sided vibrating speaker 10.

While the present disclosure has been described by means of specific embodiments, numerous modifications and variations could be made thereto by those skilled in the art without departing from the scope and spirit of the present disclosure set forth in the claims.

What is claimed is:

1. A thin double-sided vibrating speaker, comprising:

a magnet member, including a main magnetic plate, a first magnetic path unit, a second magnetic path unit and two side magnetic path units, the main magnetic plate has a central plate body and two side plate bodies, one surface of the central plate body has a first assembly part, another surface of the central plate body has a second assembly part, and the central plate body has a communication part, the communication part is communicated to the first assembly part and the second assembly part, and the central plate body is provided with at least one ventilation part that communicates the surface and another surface thereof, each the side plate body is disposed on two sides of the central plate body, a surface of each the side plate body has a third assembly part, the first magnetic path unit is disposed on the first assembly part, the second magnetic path unit is disposed on the second assembly part, each the side magnetic path unit is disposed on each the third assembly part, the first magnetic path unit and the second magnetic path unit are laminated with each other through the communication part, the side magnetic path units respectively correspond to two sides of the first magnetic path unit;

a first vibration assembly, including a first speaker frame, a first voice coil and a first diaphragm, the first speaker frame is configured with a surface of the magnet member, the first voice coil is movably configured between the first magnetic path unit and each the side magnetic path unit, the first diaphragm is configured with the first speaker frame; and a second vibration assembly, including a second speaker frame, a second voice coil and a second diaphragm, the second speaker frame is configured with another surface of the magnet member, the second voice coil is movably configured around an outer periphery of the second magnetic path unit, the second diaphragm is configured with the second speaker frame, the second speaker frame and the first speaker frame are combined with each other.

2. The thin double-sided vibrating speaker according to claim 1, wherein the first voice coil is movably configured outside the central plate body, the central plate body has four chamfers.

3. The thin double-sided vibrating speaker according to claim 1, wherein two sides of the central plate body are respectively connected to each the side plate body by a bending segment, another surface of the central plate body forms a recess of the second assembly part by the bending segments, and each the third assembly part is lower than the first assembly part, and thus the side magnetic path units respectively correspond to two sides of the first magnetic path unit.

4. The thin double-sided vibrating speaker according to claim 1, wherein two ends of each the side plate body respectively have a limiting part, an inside edge of the second speaker frame has a fixing part correspondingly connecting each the limiting part.

5. The thin double-sided vibrating speaker according to claim 1, wherein the first magnetic path unit has at least a first magnet and a first magnetic plate, the first magnet is disposed on the first assembly part, the first magnetic plate is disposed on the first magnet, the second magnetic path unit has at least a second magnet and a second magnetic plate, the second magnet is disposed on the second assembly part, the second magnetic plate is disposed on the second magnet, and the first magnet and the second magnet are laminated with each other through the communication part.

6. The thin double-sided vibrating speaker according to claim 1, wherein each the side magnetic path unit has at least one side magnet and at least one side magnetic plate, the side magnet is disposed on the third assembly part, the side magnetic plate is provided on the side magnet.

7. A thin double-sided vibrating speaker, comprising:

a magnet member, including a main magnetic plate, a first magnetic path unit, a second magnetic path unit and two side magnetic path units, the main magnetic plate has a central plate body and two side plate bodies, one surface of the central plate body has a first assembly part, another surface of the central plate body has a second assembly part, the central plate body is provided with at least one ventilation part that communicates the surface and another surface thereof, each the side plate body is disposed on two sides of the central plate body, a surface of each the side plate body has a third assembly part, the first magnetic path unit is disposed on the first assembly part, the second magnetic path unit is disposed on the second assembly part, each the side magnetic path unit is disposed on each the third assembly part, the side magnetic path units respectively correspond to two sides of the first magnetic path unit;

a first vibration assembly, including a first speaker frame, a first voice coil and a first diaphragm, the first speaker frame is configured with a surface of the magnet member, the first voice coil is movably configured between the first magnetic path unit and each the side magnetic path unit, the first diaphragm is configured with the first speaker frame; and a second vibration assembly, including a second speaker frame, a second voice coil and a second diaphragm, the second speaker frame is configured with another surface of the magnet member, the second voice coil is movably configured around an outer periphery of the second magnetic path unit, the second diaphragm is configured with the second speaker frame, the second speaker frame and the first speaker frame are combined with each other.

8. The thin double-sided vibrating speaker according to claim 1, wherein a width and a length of the first voice coil are respectively greater than a width and a length of the second voice coil, a magnetic force of the first magnetic path unit is less than a magnetic force of the second magnetic path unit.

9. The thin double-sided vibrating speaker according to claim 1, wherein two ends of one side the first speaker frame are provided with a first conductive part and a first lead groove, two leads of the first voice coil are respectively electrically connected to each the first conductive part via each the first lead groove; two ends of one side the second speaker frame are provided with a second conductive part and a second lead groove, two leads of the second voice coil are respectively electrically connected to each the second conductive part via each the second lead groove, each the first conductive part is electrically connected to each the second conductive part.

10. The thin double-sided vibrating speaker according to claim 7, wherein each the side magnetic path unit has at least one side magnet and at least one side magnetic plate, the side magnet is disposed on the third assembly part, the side magnetic plate is provided on the side magnet.

11. The thin double-sided vibrating speaker according to claim 7, wherein the first voice coil is movably configured outside the central plate body, the central plate body has four chamfers.

12. The thin double-sided vibrating speaker according to claim 7, wherein two sides of the central plate body are respectively connected to each the side plate body by a bending segment, another surface of the central plate body forms a recess of the second assembly part by the bending segments, and each the third assembly part is lower than the first assembly part, and thus the side magnetic path units respectively correspond to two sides of the first magnetic path unit.

13. The thin double-sided vibrating speaker according to claim 7, wherein two ends of each the side plate body respectively have a limiting part, an inside edge of the second speaker frame has a fixing part correspondingly connecting each the limiting part.

14. The thin double-sided vibrating speaker according to claim 7, wherein the first magnetic path unit has at least a first magnet and a first magnetic plate, the first magnet is disposed on the first assembly part, the first magnetic plate is disposed on the first magnet, the second magnetic path unit has at least a second magnet and a second magnetic plate, the second magnet is disposed on the second assembly part, the second magnetic plate is disposed on the second magnet, and the first magnet and the second magnet are laminated with each other through the communication part.

15. The thin double-sided vibrating speaker according to claim 6, wherein each the side magnetic path unit has multiple side magnets, there is an air vent formed between the adjacent side magnets, the air vent is communicated to the at least one ventilation part, and the first speaker frame and the second speaker frame are respectively provided with a corresponding breathable notch, the breathable notches communicate the at least one ventilation part.

16. The thin double-sided vibrating speaker according to claim 10, wherein each the side magnetic path unit has multiple side magnets, there is an air vent formed between the adjacent side magnets, the air vent is communicated to the at least one ventilation part, and the first speaker frame and the second speaker frame are respectively provided with a corresponding breathable notch, the breathable notches communicate the at least one ventilation part.

17. The thin double-sided vibrating speaker according to claim 7, wherein a width and a length of the first voice coil are respectively greater than a width and a length of the second voice coil, a magnetic force of the first magnetic path unit is less than a magnetic force of the second magnetic path unit.

18. The thin double-sided vibrating speaker according to claim 7, wherein two ends of one side the first speaker frame are provided with a first conductive part and a first lead groove, two leads of the first voice coil are respectively electrically connected to each the first conductive part via each the first lead groove; two ends of one side the second speaker frame are provided with a second conductive part and a second lead groove, two leads of the second voice coil are respectively electrically connected to each the second conductive part via each the second lead groove, each the first conductive part is electrically connected to each the second conductive part.

* * * * *